United States Patent [19]

Knaus

[11] Patent Number: 4,690,182

[45] Date of Patent: Sep. 1, 1987

[54] GASOLINE PUMP LEVER HOLDER

[76] Inventor: Raymond D. Knaus, 5565 Wilson Dr., Mentor, Ohio 44060

[21] Appl. No.: 843,497

[22] Filed: Mar. 25, 1986

[51] Int. Cl.[4] ..... B65B 3/04

[52] U.S. Cl. ..... 141/392; 74/526; 251/111

[58] Field of Search ..... 141/1, 98, 206, 392; 74/526; 70/456 R, 458; 251/90, 111; 24/3 K; 248/351, 360, 339, 340, 341; 7/100

[56] References Cited

U.S. PATENT DOCUMENTS 4,287,736 9/1981 Hadgis ..... 141/392

*Primary Examiner*—Houston S. Bell, Jr.

*Attorney, Agent, or Firm*—Donald A. Bergquist

[57] ABSTRACT

This invention relates to a device to hold the lever of a nozzle assembly in a position to open a valve controlling the flow of fuel from the nozzle. The principal application for this device is on the gasoline delivery nozzle assembly at a self-serve gasoline station. The device, in addition to being a convenience for the average user, is an aid to the user who may be physically handicapped or inconvenienced by arthritis or other disabling condition that would otherwise deter him from using the more economical self-serve gasoline pumps.

7 Claims, 3 Drawing Figures

GASOLINE PUMP LEVER HOLDER

This invention relates to a device to hold the lever of a nozzle assembly in a position to open a valve controlling the flow of fuel from the nozzle. The principal application for this device is on the gasoline delivery nozzle assembly at a self-serve gasoline station. The device, in addition to being a convenience for the average user, is an aid to the user who may be physically handicapped or inconvenienced by arthritis or other disabling condition that would otherwise deter him from using the more economical self-serve gasoline pumps.

The introduction of self-service gasoline pumps swept our nation during a period of rising energy costs as an effort to reduce operating costs of gasoline stations so as to reduce the effect of the escalating prices on the consumer. Whereas attendant-operated gasoline nozzles have handle latching mechanisms that allow the fuel tank to be filled while the attendant performs other maintenance tasks on the customer's automobile, the self-service gasoline nozzles are not so equipped, presenting an inconvenience to the average user and a difficulty for the user who is in any way afflicted with a disability, especially one affecting his manual dexterity or manual strength, such as from arthritis, partial paralysis, Parkinson's disease, or the like.

There are, already in the patent literature relevant to devices of the nature of the present invention, a number of devices that may meet the needs of the average user, but all of these devices either require more manual dexterity than is available in an individual who is even moderately handicapped by reasons already cited, or they fail to provide for an adjustable flow of fuel delivery to the fuel tank, which can cause the hazardous problems of splashing and fuel spillage due to overfilling.

DISCUSSION OF PRIOR ART

U.S. Pat. No. 4,278,116, issued to G. R. Opp, teaches the use of a latching device for insertion into a gas dispensing nozzle assembly to hold the dispensing handle (lever) in one of several positions selected by the user. The principle employed is that of insertion of the device between the valve actuating lever and the guard around the lever at one place or another (i.e., at the rear opening of the guard or at the side opening of the guard). The device of the Opp patent has the shortcomings of not offering ease of adjustment of flow, not offering quick removal in emergencies, and requiring two-handed dexterity to properly install.

U.S. Pat. No. 4,216,807, issued to E. J. Diamond, describes an application that is likewise inserted into a gas dispensing nozzle assembly to hold the actuating lever in one of three positions, depending upon the orientation the user selects when inserting the generally triangularly shaped appliance. The principle employed is that of insertion of the device between the valve actuating lever and the guard around the lever. The application of the Diamond patent suffers from the same shortcomings as that of the Ott patent.

Perhaps a bit easier to use is the device taught in U.S. Pat. No. 4,201,253, issued to M. J. Maloney, which device offers more easily adjusted flow rate than is offered by the invention in either of the aforementioned patents. The principle employed once agains is that of insertion of the device between the valve actuating lever and the guard around the lever. The user selects one of a series of steps on the device to engage the actuating lever of the nozzle assembly to select the desired fluid flow rate. It is possible that a user with good manual dexterity could manipulate this device using only one hand; two-handed operation and adjustment appears reasonably simple, even for the handicapped user.

U.S. Pat. No. 4,200,128, issued to A. S. Pokrzywa, teaches the use of a multi-position device to be inserted at a location that might be described as the heel of the trigger guard, which device engages the trigger guard and the end of the trigger or actuating lever in one of sevearl ledges or slots of the device to provide for a fluid flow rate selected by the user. This invention lacks the provision for simple adjustment of fuel flow and requires a fair amount of manual dexterity with both hands to apply. The principle employed once again is that of insertion of the device between the valve actuating lever and the guard around the lever.

A different operating principle is used in the invention described in U.S. Pat. No. 4,176,695, issued to W. O. Raske. Raske creates an elongated hook that engages the handle portion of the nozzle assembly with an arm that extends from the hook extension and engages the actuating lever of the nozzle assembly; the hook extension acts as a guard to warn the user that the device has not been removed from the nozzle assembly should he attempt to return the assembly to its storage location on the pump housing without first removing the device. The Raske invention does appear to offer ease of use by an individual lacking manual dexterity, but the patient does not teach user-selectable flow rates and the article is not specificially designed for quick removal in emergency situations. Raske also was granted a U.S. Pat. No. Des. 255,733, on the design of his device.

Another hook-like device is taught in U.S. Pat. No. 4,095,629, issued to R. F. Jordan. In his invention, Jordan places the hook around the hose coupling through which the fuel enters the nozzle assembly and the finger, or latching mechanism, engages the end of the trigger or actuating lever, much as did the invention of the Pokrzywa patent. Jordan's device offers multiple positions for selecting different fuel flow rates, but the adjustment clearly requires two hands and the device does not provide for rapid removal in emergency.

U.S. Pat. No. Des. 272,231 illustrates another device that hooks over the handle portion of the fuel dispensing nozzle assembly and engages the trigger or actuating lever in an open position. Only one flow position is apparent and quick removal in an emergency situation appears to be specifically barred by the design, which includes a stop in the trigger-engaging portion of the device.

Design patents for stepped wedge-like inventions for inserting between the actuating lever and the guard have also been issued. Selection of flow rate is provided by steps on the wedge. The principle of operation is straighforward in U.S. Pat. No. Des. 254,050 and in U.S. Pat. No. Des. 266,905 and the principles of operation are different from the present invention.

SUMMARY OF THE INVENTION

The present invention comprises a hook- or crescent-shaped device to engage the handle portion of a fluid dispensing nozzle assembly, such as is used to dispense gasoline and other liquid fuels, which device has step-like elements that may be selectively and releasably engaged with the actuating lever of the nozzle assembly by a rotating motion of the device for the adjustment of flow rate of fluid through the nozzle assembly. It features ease of operation, especially by users with reduced manual dexterity, owing to its relatively large outside diameter that is easily grasped by such individuals for ease of applying, adjusting, and removing the device during use thereof. Quick release of the device is a further feature directed to safety of use.

In the preferred embodiment, the device has a knurled or otherwise embossed surface on its outermost edge or periphery to provide for easy gripping. A hole through the thickness of the device provides for attachment of a chain, a loop, a lanyard, a ring, or other device that may be used to carry keys, to hang the device for storage, or simply to be present as a safety attachment. Also a thumbgrip indentation is provided for gripping the device between the thumb and a finger for providing an alternate means of applying, adjusting, or removing the device during use thereof, the principal means being the gripping of the outer surface.

DETAILED DESCRIPTION OF THE INVENTION

This invention can best be understood by reference to the accompanying drawings presented as FIGS. 1 through 4.

Figure 1:
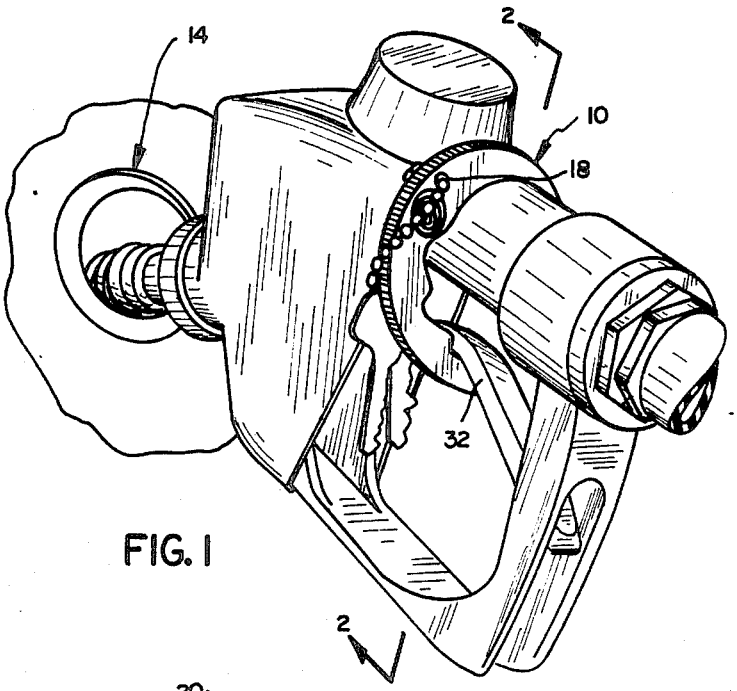
FIG. 1 illustrates the article of this invention in use on a fuel-dispensing nozzle assembly as shown in an isometric view.

In FIG. 1 is shown an isometric view of the preferred embodiment of the article of this invention 10 in use on a nozzle assembly 12 delivering fuel to a fuel tank through an opening 14. The small hole 18 in the preferred embodiment of the article is, in this case, being used to hold keys on a ball chain key ring, but this is only one use for the hole. A thumb depression 19 in the preferred embodiment provides a means for gripping the article as an alternative to gripping it by its outer surface.

Figure 2:
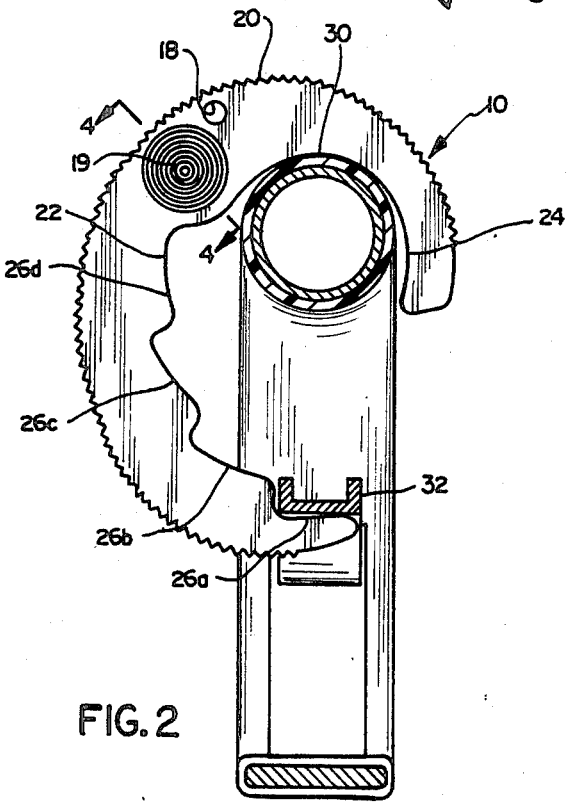
FIG. 2 shows the article of this invention holding the actuating lever of the nozzle assembly of FIG. 1, shown in cross-section, in a low-flow position.

The article of this invention can much more easily be seen in the cutaway drawing in FIG. 2. The article is shown to be of a generally crescent shape having an outer surface 20 that is preferably embossed or knurled for easy gripping, and an inner surface 22 that comprises a hook portion 24 near one end of the crescent and a stepped portion, having two or more steps 26*a*, 26*b*, 26*c*, 26*d*, thence to the other end of the crescent in opposition to the hook portion. The preferred embodiment, shown in the figures, has four steps. When the article is in use, the hook portion of the article releasably engages the outer circumference of the handle portion of the nozzle assembly 30 by partially surrounding it and the opposing step portion releasably engages the trigger or actuating lever 32 of the nozzle assembly, holding said lever in one of several selectable positions that open the fluid valve of the assembly to allow the delivery of fluid through the nozzle assembly at a selected flow rate. In FIG. 2 the lever is in a position that customarily provides a low flow rate of fluid. The article of the invention is held in place by the spring bias force that closes the fluid valve if the actuating lever is released.

An important safety feature is that there is no stop or barrier at the edge of the steps 26*a*, 26*b*, 26*c*, 26*d* that would inhibit the rapid removal of the article from its position of use should an emergency situation arise requiring rapid shut-off of the flow of fluid through the nozzle assembly. A second safety cnsideration should be that if the user plans to apply this invention to a nozzle assembly for delivering fuel, especially such fuels as gasoline or diesel fuel, he first should be certain that the nozzle assembly is of the type that will automatically stop the fuel flow when the tank being filled is full. Such nozzle assemblies are usually used on self-service fuel dispensing pumps.

Figure 3:
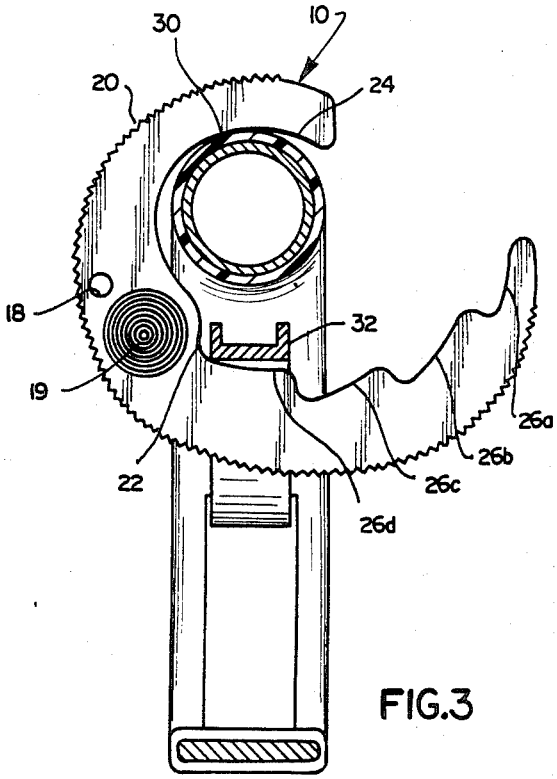
FIG. 3 shows the article of this invention holding the actuating lever of the nozzle assembly of FIG. 1, shown in cross-section, in a high-flow position.

In FIG. 3 is illustrated the general position of the article of this invention after it has been adjusted on the nozzle assembly to a position that customarily provides a high flow rate of fluid. In the preferred mode shown in the figures, two intermediate steps are present for adjustment to intermediate flow rates as desired by the user. A total of two or more steps is essential to fulfill the objects of the invention.

Figure 4:
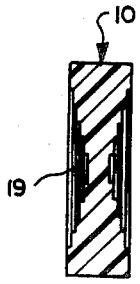
FIG. 4 illustrates in cross-section one example of the thumbgrip indentation provided in the best mode.

A detail of the thumb depression 19 is shown in FIG. 4 in cross-section. This figure shows the design selected for use in the best mode, but it should be obvious that the precise design of the thumb depression is not critical and that thumb depressions to provide ease in gripping an object have long been known in the literature.

Far more important than the design of the depression 19 is its location, and that of the hole 18, relative to the approximate axis of rotation of the device 10 about the handle portion of the dispensing nozzle. It should be noted that, owing to differences in the outer diameter of such handle portions of nozzle assemblies, and depending upon the specifics of the design of the article of this invention, the said axis of rotation may move relative to any stable reference axes. When the device is in use, however, it can be said that the axis of rotation will always be within the area enclosed by the hook portion 24 of the device and the axis will be substantially parallel to that of the valve handle about which the device rotates. The placement of the thumb depression 19 and of the small hole 18 will always be offset from the approximate axis of rotation when the device is in use, regardless of the user's selection of flow rate. This offset provides a lever arm (between the applied force and the axis of rotation) for rotating the device so that the user may quickly remove the device and therefore stop flow from the nozzle assembly in an emergency by pulling in an upward and rotary direction at the thumb depression or by pulling in an upward and rotary direction on any item attached by means of the small hole.

In the best mode, the article is made of plastic by using an injection molding process and is approximately ¼-inch in thickness. The thickness may be varied over a wide range from about 1/16-inch or less to about ½-inch or more, depending upon the material from which the article is made. In an inexpensive version that might be used as an advertising give-away item, it could be die-cut from a less permanent material such as stiff cardboard or the like. The principle employed in this invention can also be used in a wire-formed article having a hook portion and a connected and opposing step portion, each of which portions follows the shape of the corresponding portion of the inner surface 22 of the preferred embodiment shown in the figures, the article being formed from a suitable wire, rod, or rod-like material.

THE BEST MODE

To summarize the best mode of the present invention, it is an injection molded plastic article of a shape described herein and having the additional features of a thumbgrip and a small hole through the thickness at positions that provide usefulness in emergency shut-off of flow and also the feature of a knurled or embossed surface on its outermost edge for easy gripping thereof, especially by users who have reduced manual dexterity or strength. The article of the best mode is approximately ¼-inch in thickness. The best mode is further illustrated in all of the figures that are a part of this document.

Having thus described my invention is sufficient detail for one skilled in the art to reproduce my invention and obtain results similar to mine, I wish to include within the scope of my invention such articles that would be immediately obvious from the descriptions contained herein; such scope shall be limited only by the scope of the claims appended hereto.

I claim:

1. An appliance in combination with a nozzle assembly such as is used to dispense gasoline or other fluids, wherein said nozzle assemply comprises an end portion from which the dispensed fluid emerges, a variable flow rate valve, an actuating lever that operates the valve, the position of which lever effects said variable flow rate, and a handle portion, and wherein said appliance comprises an open frame including a hook portion and an opposing and interconnected stepped portion having two or more steps, which hook portion releasibly and rotatably engages said handle portion of said nozzle assembly by partially surrounding it in hook-like fashion, and said stepped portion having two or more steps, any one of which steps may be selected by the user by rotating the appliance about an axis that is substantially parallel with that of said handle portion of said nozzle assembly, thereby to releasibly engage the actuating lever on a selected step of said stepped portion for the purpose of positioning said lever and holding it unattended in a selected position to obtain a selected fluid dispensing rate from said nozzle assembly.

2. The invention described in claim 1, with the added feature that the periphery of the appliance has a knurled or otherwise embossed surface to provide for better gripping thereof.

3. The invention described in claim 1, with the added feature that a thumbgrip is provided at a position that is offset from said axis of rotation so that a quick pull at the thumbgrip in an appropriate direction will quickly disengage the appliance from the said actuating lever.

4. The invention described in claim 1, with the added feature that a hole through the appliance is provided at a position that is offset from said axis of rotation so that a quick pull in an appropriate direction on an object attached by passing through the hole will quickly disengage the appliance from the said actuating lever.

5. The invention described in claims 1, 2, 3, or 4, with the added feature that the invention is made by an injection molding process.

6. The invention described in claims 1, 2, 3, or 4, with the added feature that the invention is cut from sheet material, such as heavy cardboard, as may be achieved by an operation such as a diecutting operation.

7. The invention described in claim 1, with the added feature that the invention is made from wire, rod, or a rodlike material.

* * * * *